US007100509B2

(12) United States Patent
Veismann

(10) Patent No.: US 7,100,509 B2
(45) Date of Patent: Sep. 5, 2006

(54) DEVICE AND METHOD FOR CORRECTING A LONGITUDINAL REGISTER ERROR WHICH IS CAUSED BY POSITION ADJUSTMENT

(75) Inventor: Hermann-Josef Veismann, Horstel (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/502,042

(22) PCT Filed: Jan. 29, 2003

(86) PCT No.: PCT/EP03/00882

§ 371 (c)(1),
(2), (4) Date: Jul. 29, 2004

(87) PCT Pub. No.: WO03/066332

PCT Pub. Date: Aug. 14, 2003

(65) Prior Publication Data

US 2005/0016406 A1 Jan. 27, 2005

(30) Foreign Application Priority Data

Feb. 5, 2002 (DE) ..... 102 04 514

(51) Int. Cl.
*B41L 3/02* (2006.01)
*B41F 16/00* (2006.01)
*B41F 5/16* (2006.01)

(52) U.S. Cl. ..... 101/486; 101/142; 101/182

(58) Field of Classification Search ..... 101/486, 101/142, 182, 248, 483, 484, 181, 211, 492, 101/216
See application file for complete search history.

(56) References Cited

U.S. PATENT DOCUMENTS

| | | | | |
|---|---|---|---|---|
| 4,429,630 | A * | 2/1984 | Hajek | 101/216 |
| 4,534,288 | A * | 8/1985 | Brovman | 101/211 |
| 4,546,700 | A * | 10/1985 | Kishner et al. | 101/211 |
| 4,602,562 | A | 7/1986 | Ottenhues et al. | 101/182 |
| 4,694,749 | A * | 9/1987 | Takeuchi et al. | 101/492 |
| 4,896,600 | A | 1/1990 | Rogge et al. | 101/486 |
| 4,953,461 | A * | 9/1990 | Gaffney et al. | 101/142 |
| 5,056,430 | A * | 10/1991 | Bayerlein et al. | 101/211 |
| 5,771,805 | A * | 6/1998 | Branas et al. | 101/248 |
| 5,887,526 | A | 3/1999 | Zahnd | 101/182 |
| 6,634,297 | B1 | 1/2003 | Poetter et al. | 101/483 |
| 6,615,732 | B1 * | 9/2003 | Hunold et al. | 101/486 |

FOREIGN PATENT DOCUMENTS

| | | |
|---|---|---|
| DE | 37 42 129 A1 | 6/1989 |
| DE | 195 27 199 A1 | 1/1997 |

(Continued)

*Primary Examiner*—Minh Chau
*Assistant Examiner*—Wasseem H. Hamdan
(74) *Attorney, Agent, or Firm*—Jacobson Holman PLLC

(57) ABSTRACT

A process for correcting the longitudinal registration error of a rotary printing press with several inking systems in which a control unit adjusts the desired application line of the printing plate on the material web lying on one of the two rollers. In making the adjustment, the control unit takes into account the shift of the effective print line that arises as a consequence of an adjustment movement of one of the two rollers along an axis that does not run coincident with the connecting line of the axes of rotation of the two rollers, and determines correction values from the relative positions of the two rollers and the inking system, and the angle between the connecting line of the axes of rotation and the axis of adjustment.

19 Claims, 6 Drawing Sheets

FOREIGN PATENT DOCUMENTS

| | | | |
|---|---|---|---|
| DE | 196 14 818 | A1 | 10/1997 |
| EP | 0 177 886 | A3 | 4/1986 |
| EP | 1 249 346 | A1 | 1/2003 |
| GB | 214 6291 | A | 4/1985 |

* cited by examiner

DEVICE AND METHOD FOR CORRECTING A LONGITUDINAL REGISTER ERROR WHICH IS CAUSED BY POSITION ADJUSTMENT

This is a nationalization of PCT/EP03/00882 filed Jan. 29, 2003 and published in German.

BACKGROUND OF THE INVENTION

1. Field of the Invention

The present invention relates to a process for the correction of the longitudinal registration error of a rotary printing press with several inking systems in which a control unit adjusts the desired application line of the printing plate on the material web lying on one of the two rollers by controlling the drive or drives of the two rollers directly involved in the printing process of an inking system, so that the two rollers have, at least during a period of time, a different circumferential speed.

2. Description of the Related Art

The printing of multi-color print images with rotary printing presses is done, as a rule, by the print substrate running through various inking systems in sequence, each of said inking systems imparting one color so that the multi-color print image arising arises as an overlay of several print images. Great importance is attached to the precision with which this layering is performed. Shifts of the various print images with respect to one another in the printing direction are called longitudinal registration errors. The deviations called longitudinal registration errors or the circumferential registration errors are, as a rule, corrected by the press operator at the beginning of the printing process by the press operator controlling the relative position of so-called registration marks that are applied by the various inking systems. However, this process has the disadvantage of a long reaction time and the large number of rejects associated therewith.

Thus, DE 195 27 199 proposes, in reference to a flexographic printing press, to register the registration marks with recognition sensors during the entire printing process, to supply the results of the measurement of the sensors to a control and computer unit, and to perform the longitudinal registration correction by the print cylinder being run, at least for a short period of time, at a different circumferential speed than the impression cylinder.

In the application of the process sketched in DE 195 27 199 for the correction of the longitudinal registration error during the entire printing process, it is, however, required that said optical recognition sensors monitor the print image long-term, supply the control unit with measurement signals, whereupon the same performs the control of the speed of the various print rollers necessary for the registration correction.

This process requires, therefore, among other things, a long-term optical monitoring of the print image.

SUMMARY OF THE INVENTION

Thus, it is the objective of the present invention to propose a process that gets by without long-term monitoring.

This objective is realized by a process for correcting the longitudinal registration error of a rotary printing press with several inking systems in which a control unit adjusts the desired application line of the printing plate on the material web lying on one of the two rollers by controlling the drive or drives of the two rollers directly involved in the printing process of an inking system, so that the two rollers have, at least during a period of time, a different circumferential speed. The control unit takes into account the shift of the actual, effective print line on the circumference of both rollers in the correction, which arises as a consequence of an adjustment movement of one of the two rollers involved in the printing process along an axis that does not run coincident with the connecting line of the axes of rotation of the two rollers involved in the printing process. The control unit determines correction values from the relative positions of the two rollers directly involved in the printing process and the inking system, and the angle between the connecting line of the axes of rotation of the two rollers involved in the printing process and the axis of adjustment.

The invention is based on the insight that, in proofing presses as well as in the operation of rotary printing presses, there is the necessity of adjusting the position of the rollers involved in the printing process relative to one another. In the circles of those skilled in the art, this adjustment of position is called the adjustment process.

In order to make possible this adjustment process, printing presses have suitable bearing for the rollers involved in the printing process. Thus, from DE 40 01 735 A 1 a flexographic printing press is known in which the carriages carrying the printing rollers and the carriages carrying the color application or anilox rollers are guided in a common carriage guide of the inking system bracket of the printing press and can be traversed, jointly or individually, by spindle drives.

In the case of rotary printing presses of this known type, the adjustment of the print image is normally done as follows. An electronic control device is provided that can access data input into a storage device. The data relate to the adjustment travel between the print roller and the impression roller, taking into account the geometric dimensions of the press and the diameter of the rollers.

This control device then adjusts the relative roller position so that it is supposed to be ensured that all the parts of the print image are transferred.

However, the various rollers, printing plates, the materials to be printed on, and all the other parts involved have geometrical tolerances so that an additional adjustment process often becomes necessary. This adjustment process is done by the printing press operator who adjusts the roller positions while observing the print image.

Through this type of adjustment of the print image, it is ensured that a complete transfer of the print image takes place with the lowest contact pressure of the rollers involved in the printing process against one another. Additional details relating to the adjustment process, which can run completely automatically, are contained in the still unpublished German patent application with the file number 101 45 957.2.

Along with the sketched adjustment to be performed during the contact process, it is often necessary to carry out a so-called dynamic adjustment process. By this, the following is to be understood:

At higher printing speeds changes of the effective diameter of rollers involved in the printing process occur. Affected thereby are, for example, the printing plate rollers in flexographic printing.

The printing plates of these rollers are pressed at the printing line between the printing plate and impression rollers. At higher rotational speeds, the roller no longer reaches its actual radius measured before the printing process, as the restoration speed of the flexible printing plate material is not sufficient. However, with the use of very flexible materials, it is possible that the effective diameter increases as a consequence of the centrifugal force dependent on rotary speed.

In both cases, the pressure between the rollers directly involved in the printing process changes. This situation is addressed with an additional adjustment process, the so-called dynamic adjustment. It is expedient in this connection to perform this type of adjustment automatically by a control unit determining the necessary corrections of the relative positions of the rollers as a function of the often empirically recorded material parameters of the rollers and the printing speeds.

An investigation of the geometric arrangement of the two rollers directly involved in the printing process of an inking system yields, however, that most adjustment movements in printing presses of the known type are done along axes that do not run parallel to the connecting line of the axes of rotation of the two rollers involved in the printing process. Adjustment movements of this type thus induce a shift of the actual effective printing line on the circumference of the rollers. Each shift of the printing line leads to a longitudinal registration error.

Calculations show that the percentage of these errors that are longitudinal registration errors occurring during the printing process is significant and, in part, even exceeds the percentage of all other errors.

Thus, an effective longitudinal registration error correction can be performed with the process according to the invention without the control device being constantly loaded with evaluation and calculation operations, as in the case of the process according to DE 40 01 735 A1. As a rule, the parameters necessary to carry out the process, such as the instantaneous relative position of the rollers of the individual printing presses, are known to the known control units so that the process can be carried out entirely without additional measurement devices, such as expensive optical sensors. Moreover, it is possible to implement the process according to the invention, so that the control device only determines the correction values when changes of the relative position of the rollers have actually been made so that the calculational and control expense is also limited.

Nonetheless, the process according to the invention can be combined with other known processes. Thus, it is possible in the preregistration or at certain intervals of time to check with optical sensors, and to accordingly correct the adherence to registration. However, through the use of the process according to the invention, the necessity of constantly carrying out measurement and calculation processes is eliminated.

Additional embodiment examples of the invention are explained in the description of the object.

BRIEF DESCRIPTION OF THE DRAWINGS

The following sets forth a brief description of figures.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
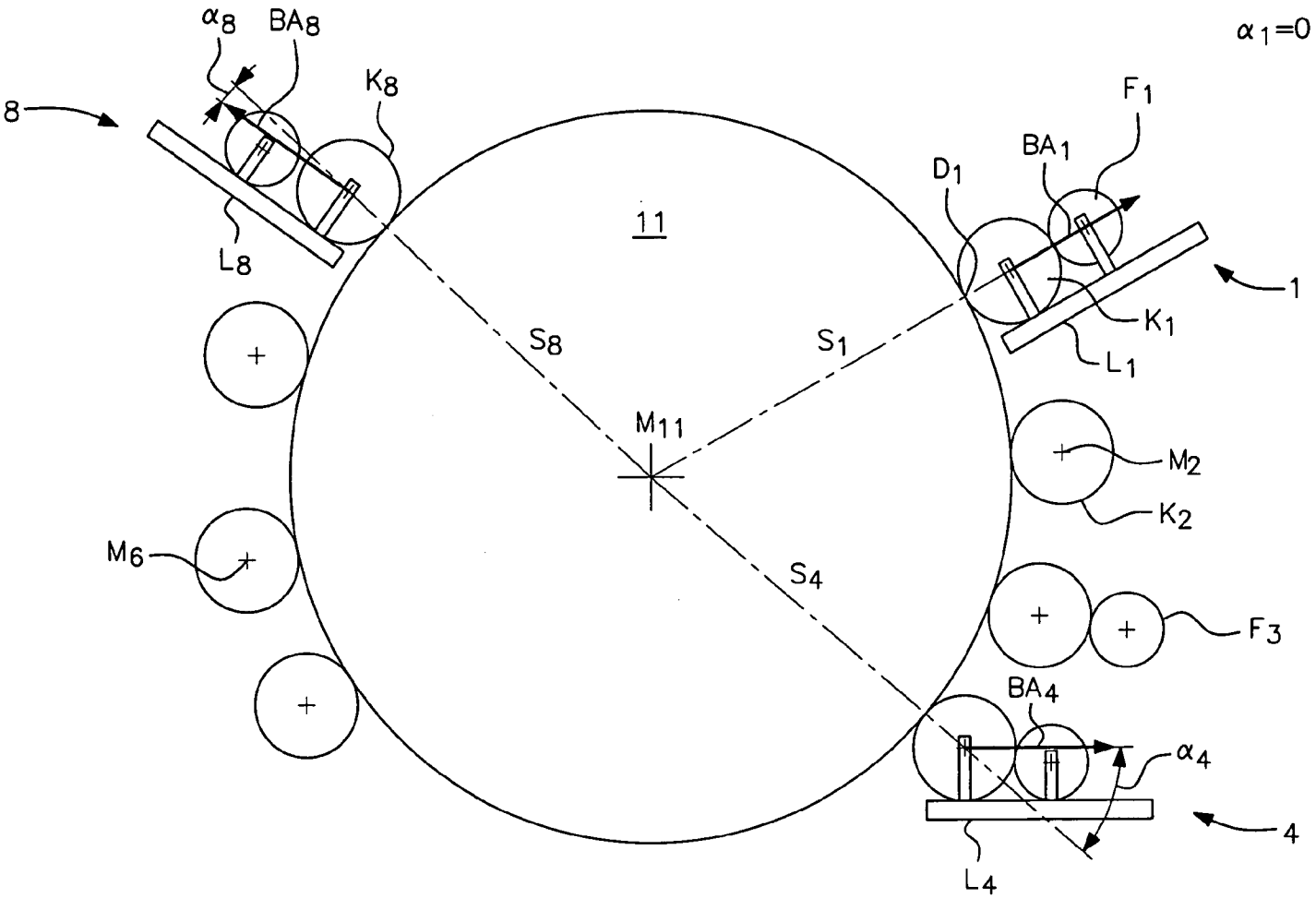
FIG. 1 shows, schematically, a flexographic printing press with a plurality of printing presses.

FIG. 1 shows schematically the arrangement of inking systems 1 to 8 of a flexographic printing press 10 around an impression cylinder 11, where only the inking systems 1, 4, and 8 are completely represented. For the other inking systems, only the position of the printing plate rollers is specified. The inking systems are suspended on a press frame that is not represented. The inking system n (n denotes an arbitrary one of the inking systems present) includes a printing plate roller $K_n$ and an inking system $F_n$. The axes of rotation of the printing plate rollers are denoted by $M_n$; the axis of rotation of the impression cylinder is denoted by $M_{11}$. As shown, the axes of rotation $M_n$ and the axis of rotation $M_{11}$ are generally parallel with one another. The effective print lines between the printing plate rollers $K_n$ and the impression cylinder 11 are denoted by $D_n$. The lines that connect the axis of rotation $M_{11}$ and the print lines $D_n$ are denoted by $S_n$. As show, these connecting lines $S_n$ run generally perpendicularly to the axes of rotation $M_n$ and $M_{11}$. Between the lines $S_n$ and the axes of the adjustment movement $BA_n$, $\alpha_n$ arise.

The inking systems 1, 4, and 8 show, by way of example, various possibilities for the alignment of the inking systems or the axes of the adjustment movement BA relative to the lines $S_n$, while the other printing systems are merely sketched. Thus, the adjustment axis $BA_1$ runs on the line $S_1$, so that, in an adjustment, no shift of the print line results. Such an arrangement would be called a strictly linear arrangement of the inking systems. However, such an arrangement is very demanding from the standpoint of press construction and thus not to be considered relevant for modern printing presses.

An approximately linear arrangement is shown with the aid of inking system 8. The axis of the adjustment $BA_8$ does not run on the line $S_8$ and the angle $\alpha_8$ arises between the adjustment $BA_8$ and the line $S_8$. Each adjustment movement of the roller $K_8$ leads to a shift of the effective print line $D_8$ on the circumference of the rollers involved, 11 and $K_8$.

From the standpoint of press technology and manufacturing technology, the simplest variant of the arrangement of an inking system to implement is the so-called drawer arrangement, which is shown with the aid of the inking system 4. Here, the axis of the adjustment $BA_4$ runs horizontally so that the angle $\alpha_4$ and the registration error arising due to the adjustment is still greater than in the inking system 8.

Figure 2:
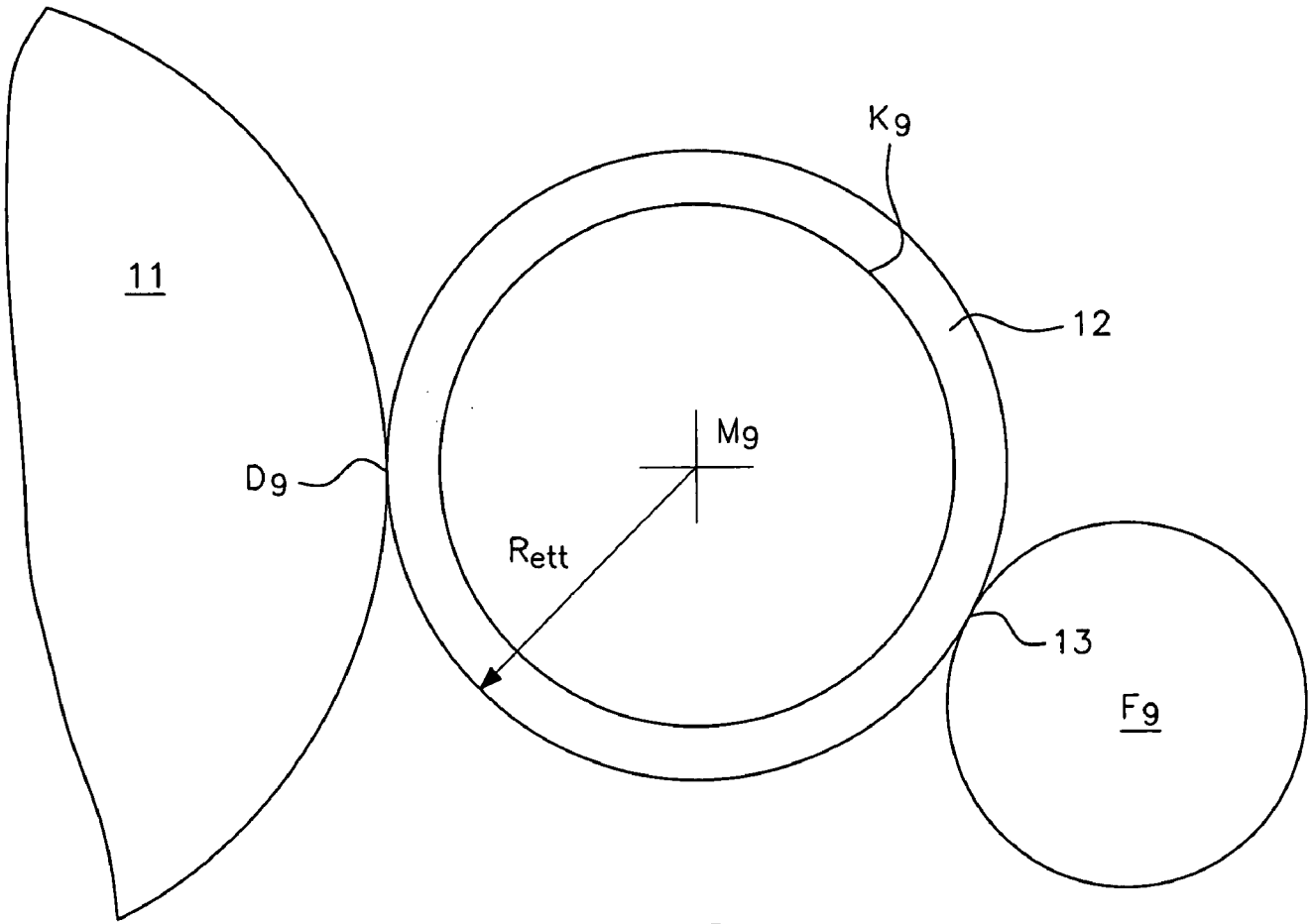
FIG. 2 shows, schematically, a printing plate roller in the printing process.

FIG. 2 shows, in the example of a printing plate roller $K_9$, the position of the printing plate roller $K_9$ during the printing process. The printing plate roller $K_9$ and other materials flexibly involved in the printing process, such as the unrepresented rubber coating of the impression cylinder and the also unrepresented print substrate, are exposed to strong forces in the printing process. Thus, the print plate 12 is squeezed between the impression cylinder 11 and the printing plate roller $K_9$ along the print line $D_9$. A similar process takes place on the print line 13 between the printing plate roller $K_9$ and the inking system $F_9$. In a rapid rotation of the roller $K_9$ about its axis of rotation $M_9$, it can occur that the deformation, among other things, of the printing plate on the aforementioned print lines $D_9$ and 13 is no longer moistened by the restoring forces of the squeezed material 11, 12, $K_9$, $F_9$ before the squeezed material once again reaches the print lines $D_9$ or 13. Thus, in this case, the effective radius $R_{eff}$, which denotes the distance between the outer circumference of the printing plate and the axis of rotation $M_9$ immediately before the repeated reaching of the print line $D_9$, is reduced. However, this effective radius $R_{eff}$ is decisive for the quality of the printing process. In the case described above of the shrinking of the effective radius, the physical pressure on the print line can lessen and an effect on the ink transfer to the print substrate can occur. In this case, the press operator or the press control of a flexographic printing press will set the printing plate roller more strongly on the impression cylinder 11.

From the viewpoint of the high centrifugal forces, however, with the use of other materials, an increase of the effective radius $R_{eff}$ can occur, which brings with it an increase of the physical pressure on the print line $D_9$. In this case, the printing plate roller $K_9$ is run somewhat further from the impression cylinder 11. In general, both processes are included under the term dynamic adjustment.

Figure 3:
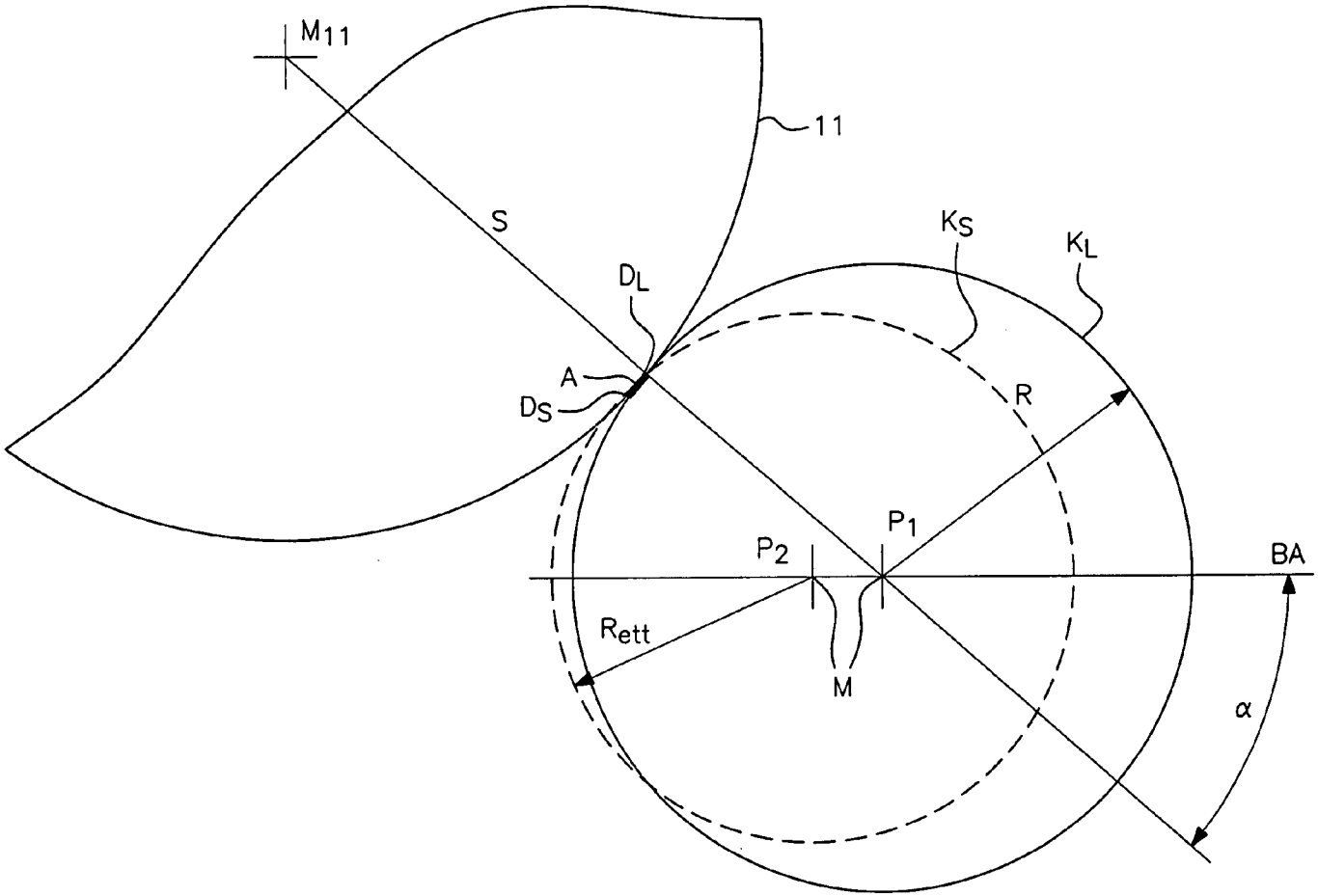
FIG. 3 shows, schematically, the consequences of a dynamic adjustment according to the present invention.

FIG. 3 illustrates, in the example of a sketched inking system whose elements are provided with reference numbers without indication of the inking system enumeration, the geometric relationships if the angle a deviates from 0°.

During the contact process, the slowly rotating printing plate roller $K_l$ has a radius R that hardly varies over its entire circumference and is positioned on the impression cylinder 11.

The position and the radius of the rapidly running printing plate roller $K_s$, which is represented here by a dotted line, illustrated the further course of the printing process. In the case of an increase of the printing speed, the radius, relevant for the printing process, of the printing plate roller is reduced in this embodiment example from R to $R_{eff}$. In order, despite this, to ensure an optimal ink transfer, the axis of rotation M of the printing plate roller is traversed from the position $P_1$ into the position $P_2$. The latter position forms the midpoint of the rapidly running printing plate roller $K_S$, represented as a dotted line. FIG. 3 shows that the printing plate roller $K_s$, has, due to the adjustment process, a print line $D_s$ with the impression cylinder 11, which, at another position, is found as the print line $D_l$ of the slowly rotating $K_l$. The interval A between both print lines leads to a longitudinal registration error that is to be remedied with the process according to the invention. It is understood that the change of the radius in the course of the printing process in FIG. 3 was not represented to scale for reasons of representation.

Figure 4:
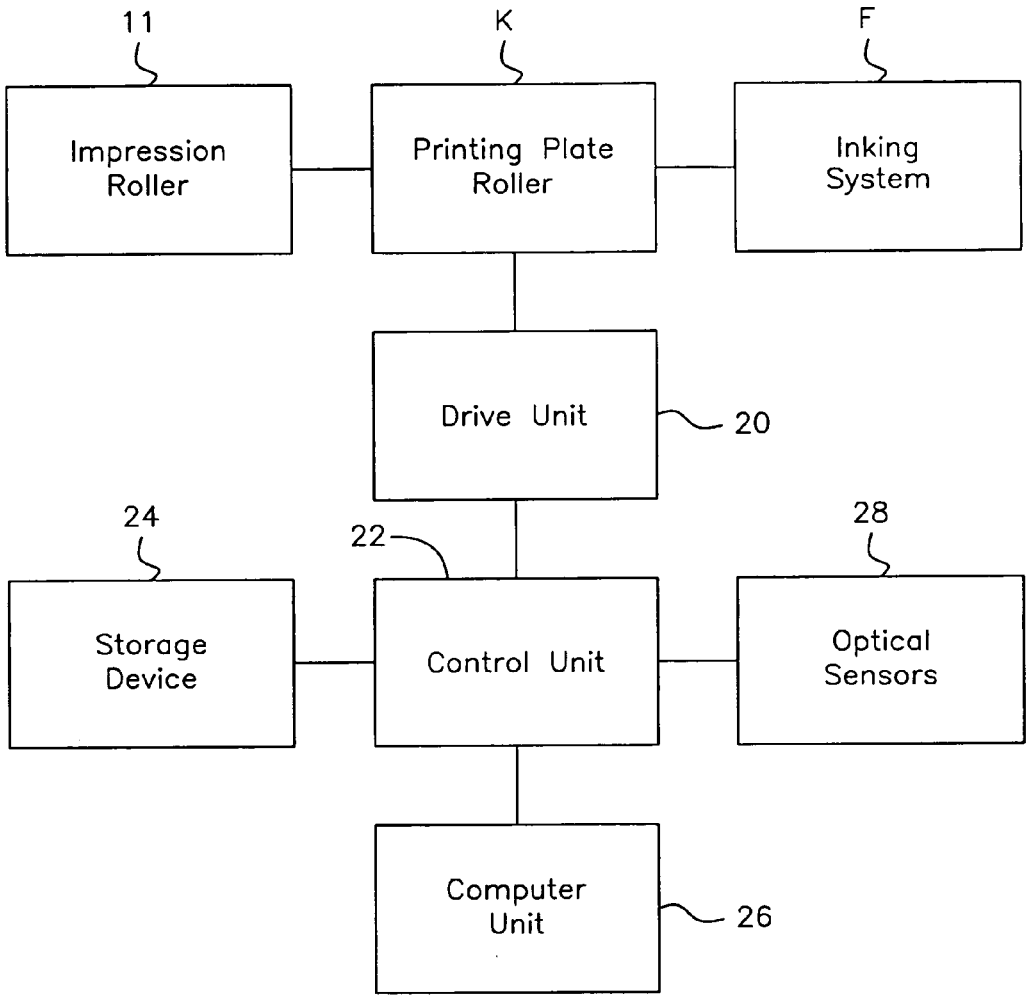
FIG. 4 is a block diagram of the components of a printing press in accordance with the present invention.

FIG. 4 sets forth the components of a printing press in accordance with the present invention including at least two rollers 11, K, and an inking system F, as are depicted in FIG. 1. In addition, at least one drive unit 20 is associated with at least one of the rollers, the drive unit 20 being controlled by the control unit 22. The control unit 22 determines correction values for correcting longitudinal registration error and, in doing so, may access correction values from a storage device 24 or use a computer 26 running a computational algorithm. The control unit 22 may also perform a preregistration by evaluating the relative positions of the components of the print images that are plotted by optical sensors 28. The relative positions plotted by the optical sensors 28 may also be used by the control unit to perform registration corrections at regular intervals of time.

Figure 5:
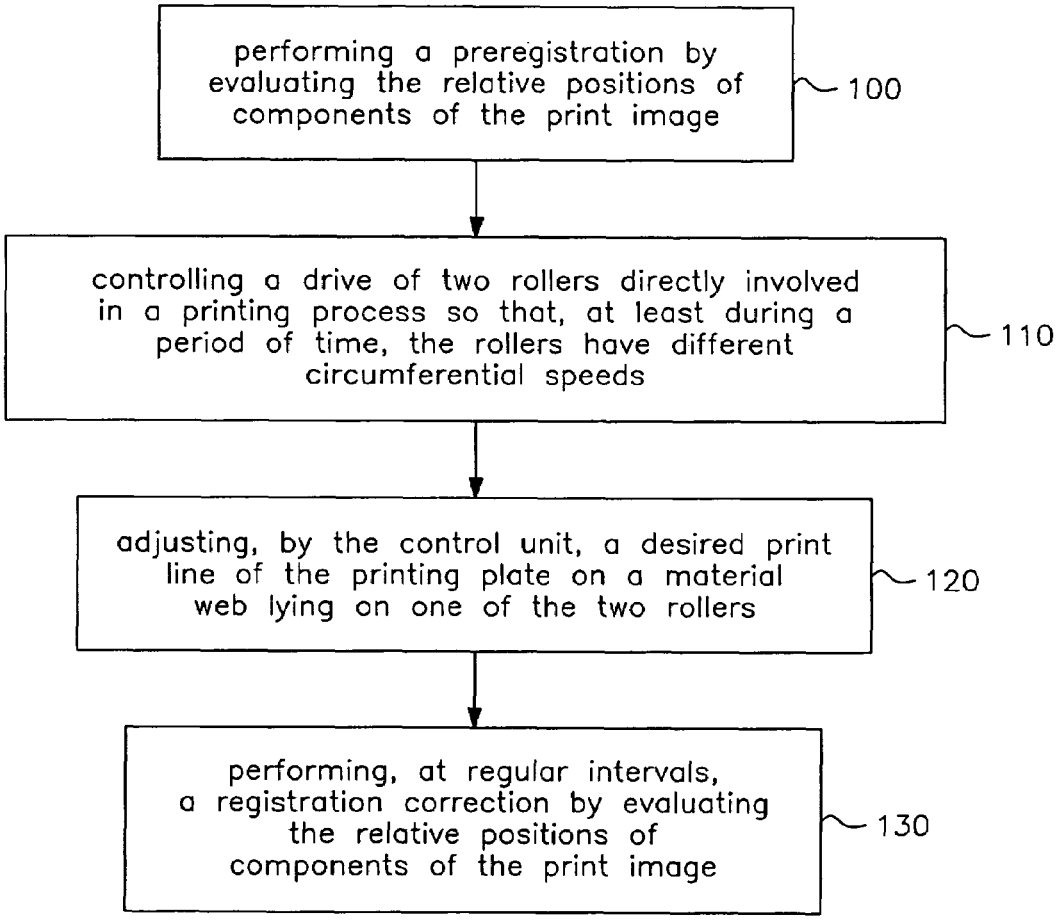
FIG. 5 is a flow chart of the process according to the present invention.

FIG. 5 summarizes the process for correcting a longitudinal registration error of a rotary printing press having a plurality of inking systems $F_n$, at least two rollers 11, $K_n$ having respective axes of rotation $M_n$, $M_{11}$ joined by a connecting line $S_n$ and being directly involved in the printing process of an inking system, and a control unit 22, according to the present invention. As shown, the process includes performing a preregistration, step 100, by evaluating the relative positions of components of the print image. The process then includes controlling, step 110, a drive of two rollers directly involved in the printing process so that, at least during a period of time, the rollers have different circumferential speeds. The process further includes adjusting by the control unit, step 120, a desired print line of the printing plate on a material web lying on one of the two rollers. A further step may be undertaken by the control unit which includes performing, step 130, a registration correction by evaluating the relative positions of components of the print image at regular intervals of time. In both of steps 100 and 130, the relative positions of components of the print image may be provided to the control unit by optical sensors.

Figure 6:
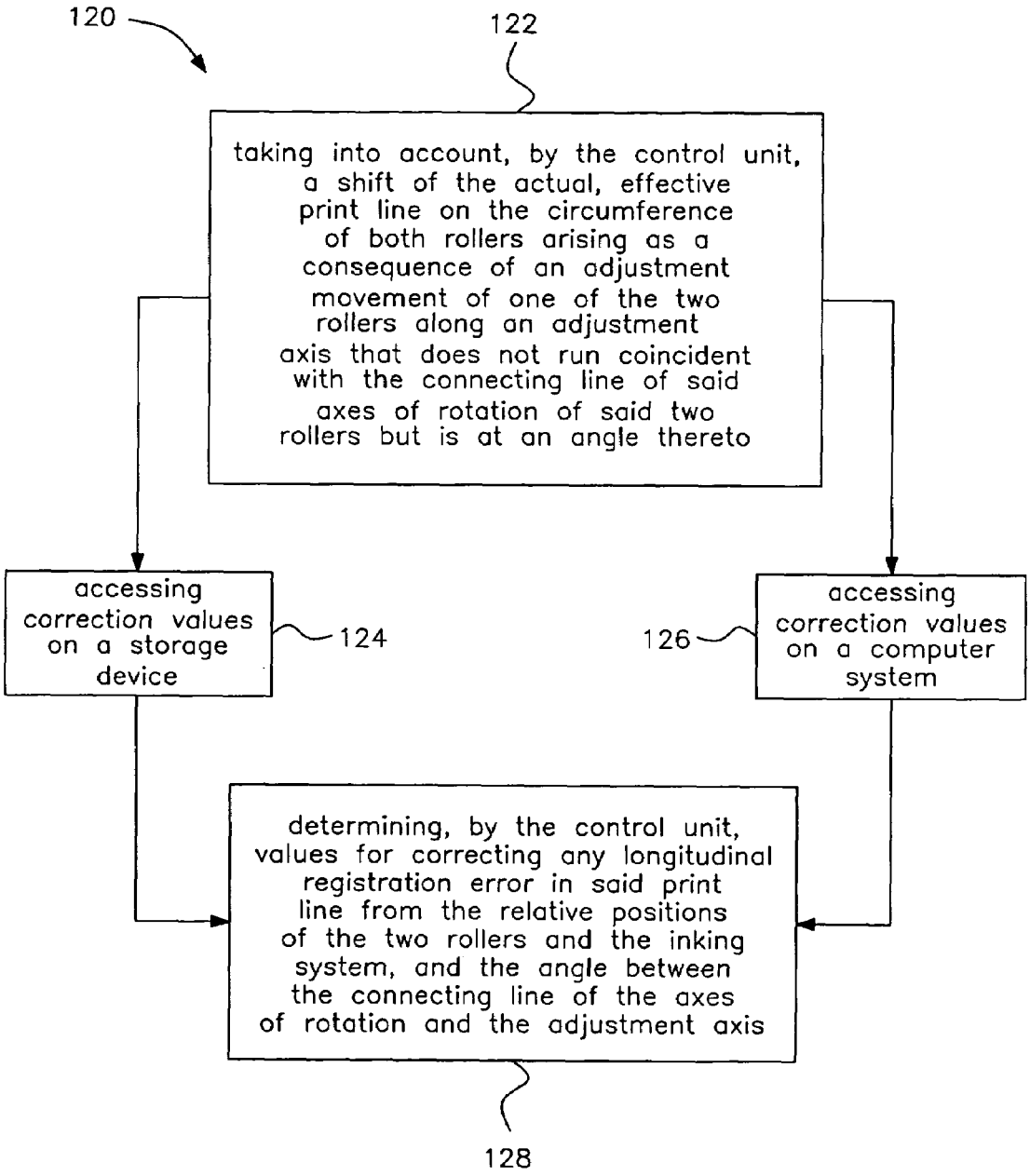
FIG. 6 is a more detailed flow chart of the adjusting step of FIG. 5.

As further defined in FIG. 6, step 120 includes the steps of taking into account by the control unit, step 122, a shift (A) of the actual, effective print line on the circumference of both rollers 11, $K_n$ arising as a consequence of an adjustment movement of one of the two rollers along an adjustment axis $BA_n$ that does not run coincident with the connecting line $S_n$ of the axes of rotation $M_n$, $M_{11}$ of the two rollers but is at an angle thereto. The method may include accessing, step 124, correction values on a storage device 24, or accessing, step 126, correction values on a computer unit 26 running a computational algorithm. The method then includes determining by the control unit, step 128, values for correcting any longitudinal registration error in the print line from the relative positions of the two rollers and the inking system, and the angle $\alpha$ between the connecting line $S_n$ of the axes of rotation and the adjustment axis $BA_n$.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A process for correcting a longitudinal registration error of a rotary printing press having a plurality of inking systems, at least two rollers arranged adjacent one another and directly involved in the printing process of an inking system, and a control unit, said rollers having respective axes of rotation joined by a connecting line, and at least one of said rollers having a printing plate, said process comprising:

adjusting, by said control unit, a desired print line of the printing plate on a material web lying on one of the two rollers by controlling a drive of the two rollers so that, at least during a period of time, said rollers have different circumferential speeds, said step of adjusting by said control unit including, taking into account, by the control unit, a shift of the actual, effective print line on the circumference of both rollers arising as a consequence of an adjustment movement of one of the two rollers along an adjustment axis that does not run coincident with the connecting line of said axes of rotation of said two rollers but is at an angle thereto; and determining, by the control unit, values for correcting any longitudinal registration error in said print line from relative positions of the two rollers and the inking system, and said angle between the connecting line of the axes of rotation and the adjustment axis.

2. The process according to claim 1, wherein when said step of adjusting is performed, said axes of rotation are generally parallel with one another and said connecting line extends generally perpendicularly to said axes of rotation.

3. The process according to claim 1, wherein in determining the correction values, the control unit accesses correction values on a storage device in which said correction values are plotted as a function of the relative roller positions.

4. The process according to claim 1, wherein in determining the correction values, the control unit accesses correction values on a computer unit that determines said correction values from the relative positions of the two rollers and the angle between the connecting line of the axes of rotation and the adjustment axis using a computational algorithm.

5. The process according to claim 1, wherein the control unit first performs a preregistration by evaluating the relative positions of components of the print images that are plotted with optical sensors.

6. The process according to claim 5, wherein said step of performing a preregistration is performed during a printing process.

7. The process according to claim 1, wherein the control unit performs, at regular intervals of time, a registration correction by evaluating the relative positions of components of the print images that are plotted with optical sensors.

8. A rotary printing press for a printing process on a material web, comprising:

at least two rollers directly involved in the printing process, said rollers having respective axes of rotation joined by a connecting line, at least one of said rollers having a printing plate and an associated inking system;

at least one drive unit associated with said rollers; and a control unit configured to adjust a desired print line of the printing plate on the material web lying on one of the two rollers by controlling said at least one drive unit so that said rollers have, at least during a period of time, different circumferential speeds;

said control unit further being configured to take into account, in performing said adjustment, a shift of an actual, effective print line on a circumference of said rollers due to an adjustment movement of one of the two rollers along an adjustment axis that does not run coincident with said connecting line but is at an angle thereto, and said control unit being still further configured to determine values for correcting any longitudinal registration error in said actual print line from relative positions of the two rollers and the associated inking system and the angle between the connecting line of the roller axes of rotation and the adjustment axis.

9. The rotary printing press according to claim 8, wherein said axes of rotation are generally parallel with one another and said connecting line extends generally perpendicularly to said axes of rotation.

10. The rotary printing press according to claim 8, wherein in determining the correction values, the control unit accesses correction values on a storage device in which said correction values are plotted as a function of the relative roller positions.

11. The rotary printing press according to claim 8, wherein in determining the correction values, the control unit accesses correction values on a computer unit that determines said correction values from the relative positions of the two rollers and the angle between the connecting line of the axes of rotation and the adjustment axis using a computational algorithm.

12. The rotary printing press according to claim 8, wherein the control unit first performs a preregistration by evaluating the relative positions of components of the print images that are plotted with optical sensors.

13. The rotary printing press according to claim 8, wherein the control unit performs, at regular intervals of time, a registration correction by evaluating the relative positions of components of the print images that are plotted with optical sensors.

14. A rotary printing press for a printing process on a material web, comprising:

an impression roller;

at least one printing plate roller with an associated inking system, said printing plate roller being positioned immediately adjacent said impression roller so that an effective print line is formed on a circumference of said rollers, axes of rotation of said rollers being joined by a connecting line; and a control unit configured to adjust the print line of the printing plate roller on the material web lying on one of the rollers to correct a longitudinal error in the printing pcoess by controlling a circumferential speed of said rollers so that, at least during a period of time, said rollers have different circumferential speeds;

said control unit further being configured to take into account, in performing said adjustment, a shift of the effective print line due to an adjustment movement of one of the two rollers along an adjustment axis that does not run coincident with said connecting line, and said control unit being still further configured to determine values for correcting any longitudinal registration error in said print line from the relative positions of the two rollers and the inking system and an angle between the connecting line of the roller axes of rotation and the adjustment axis.

15. The rotary printing press according to claim 14, wherein said axes of rotation are generally parallel with one another and said connecting line extends generally perpendicularly to said axes of rotation.

16. The rotary printing press according to claim 14, wherein in determining the correction values, the control unit accesses correction values on a storage device in which said correction values are plotted as a function of the relative roller positions.

17. The rotary printing press according to claim 14, wherein in determining the correction values, the control unit accesses correction values on a computer unit that determines said correction values from the relative positions of the two rollers and the angle between the connecting line of the axes of rotation and the adjustment axis using a computational algorithm.

18. The rotary printing press according to claim 14, wherein the control unit first performs a preregistration by evaluating the relative positions of components of the print images that are plotted with optical sensors.

19. The rotary printing press according to claim 14, wherein the control unit performs, at regular intervals of time, a registration correction by evaluating the relative positions of components of the print images that are plotted with optical sensors.

* * * * *